US006367185B1

(12) United States Patent
Fraser

(10) Patent No.: US 6,367,185 B1
(45) Date of Patent: Apr. 9, 2002

(54) UNIVERSAL SHAMPOO INDENTIFICATION LOGO

(76) Inventor: Ann Fraser, 27185 Glenview Dr., Lo'L, FL (US) 34639

( * ) Notice: Subject to any disclaimer, the term of this patent is extended or adjusted under 35 U.S.C. 154(b) by 0 days.

(21) Appl. No.: 09/524,953

(22) Filed: Mar. 14, 2000

(51) Int. Cl.[7] ..... G09F 3/10
(52) U.S. Cl. ..... 40/638; 434/115
(58) Field of Search ..... 40/638; 434/112, 434/113, 114, 115

(56) References Cited

U.S. PATENT DOCUMENTS

| | | | | | |
|---|---|---|---|---|---|
| 110,760 | A | * | 1/1871 | Harrison | 206/534 |
| 383,394 | A | | 5/1888 | Higgins | |
| 514,133 | A | | 2/1894 | Valentine | |
| 889,394 | A | | 6/1908 | Newman | |
| 1,214,938 | A | | 5/1917 | Metcalfe | |
| 1,238,551 | A | | 8/1917 | Merklee et al. | |
| 1,662,469 | A | | 3/1928 | Palmer | |
| 2,466,502 | A | * | 4/1949 | Stiller | 74/558 |
| 4,416,166 | A | * | 11/1983 | Jannard et al. | 74/551.9 |
| 4,676,861 | A | * | 6/1987 | Bishop | 156/527 |
| 4,715,743 | A | * | 12/1987 | Schmanski | 404/9 |
| 4,895,257 | A | * | 1/1990 | Winslow | 206/534 |
| 4,951,533 | A | * | 8/1990 | Hillinger | 81/177.1 |
| 5,011,032 | A | * | 4/1991 | Rollman | 215/230 |
| 5,417,574 | A | * | 5/1995 | Raynes | 434/112 |
| 5,753,350 | A | * | 5/1998 | Bright | 428/195 |
| 6,047,992 | A | * | 4/2000 | Hampton | 283/81 |

* cited by examiner

*Primary Examiner*—B. Dayoan
*Assistant Examiner*—Kenn Thompson

(57) ABSTRACT

The present invention is that of a new and improved apparatus for assisting a blind or visually impaired person in locating a shampoo bottle or other bottle located within a shower. The apparatus would be a plurality of small adhesive tags attached to each other but allowing a user to separate them by incorporated perforations. Each of the tags would have a plurality of incorporated raised bubbles on its front surface. The back surface would include a peel-away backing, which would cover a sticky coating on the back surface of the small adhesive tags until the small adhesive tags would be ready for use. Each bubble on each of the adhesive tags would be manufactured to include a micro-suction cup top-mounted on each bubble, providing the user with a more secure grip. The plurality of adhesive tags would be designed to come in a roll and would be packaged within a roll dispenser box, with the roll of adhesive tags connected to and surrounding a roller located inside the roll dispenser box. A roll dispenser box would include a slot opening to allow a plurality of small adhesive tags to be removed from the roll dispenser box and attached to a cylindrical object as needed.

3 Claims, 2 Drawing Sheets

HUB
SIDE VIEW DISPENSER
MATERIAL EXIT SLOT 4
6
2

Perforation
Adhesive Backing
Micro Suction Cup

UNIVERSAL SHAMPOO INDENTIFICATION LOGO

I BACKGROUND OF THE INVENTION

The present invention is that of a new and improved apparatus for assisting a blind or visually impaired person in locating a shampoo bottle or other bottle located within a shower.

II DESCRIPTION OF THE PRIOR ART

There are a wide variety of identification devices in the prior art that are used to identify an object using the sense of touch. One example is U.S. Pat. No. 1,662,469, issued to Palmer, which discloses improvements in safety harnesses for poison bottles, and more particularly relates to a casing or sheath, into which a bottle may be introduced and which furnishes a cautioning or warning signal of the nature of the bottle content. The casing or sheath provides a warning or protective casing, which may be fitted to bottles of different shapes and capacities and constitutes a complete envelope for the bottle that is readily distinguishable by touch or sight of the bottle.

U.S. Pat. No. 1,238,551, issued to Merklee et al, disclosed a means for distinguishing containers, bottles, boxes and the like, and has for an object the provision of an improved construction designed to be applied to said containers, bottles, boxes and the like whereby they may be readily distinguishable either in the dark or in the light. The construction of the label and guard is such that the same will cause a person to observe the label on looking at the bottle or other container, or in case of darkness, when at a person feels the bottle or other container, the special shape and make-up of the label will indicate that such container or the like has positioned inside poison, explosives, or some other matter of a dangerous nature.

U.S. Pat. No. 1,214,938, issued to Metcalfe, discloses a poison indicating attachment for bottles, and has for its object to provide a device of this character which embodies novel features of construction whereby a person will be warned upon gripping a bottle that it contains poison, thereby avoiding any possibility of the poison being taken by mistake or accident. This invention comprises a continuous strip of sheet metal which may come in a roll or the like, said strip containing a plurality of outwardly projecting prongs which may be conveniently pressed outward from the body portion of the strip. The metal strip is designed to be placed only around the neck of the bottle.

U.S. Pat. No. 889,394, issued to Newman, discloses an apparatus designed to warn a user of the contents of a particular bottle, which contains prick points, a stopper, and a wire fastened to the stopper and adapted to engage the prick points.

U.S. Pat. No. 541,133, issued to Valentine, discloses a four-sided bottle, which includes two substantially flat adjacent smooth side walls adapted for a label, and two substantially flat adjacent rough side walls roughened with warning projections.

U.S. Pat. No. 383,394, issued to Higgins, discloses a band that surrounds the bottom part of a bottle, and barbed sheet-metal strips extending upward from the band, the upper ends of the strips being held on the bottle neck by a band or cord, serving as a warning signal for a user if a bottle is grabbed in haste.

As can be seen from the prior art, much of the prior art has a potential to injure or infect a person grabbing a bottle with the various inventions located on them. The present invention eliminates that by providing a readily distinguishable object, while removing the possibility that the present invention will puncture a person's skin. In addition, none of the prior art comes in a "one size fits all" which would allow a specific unit of that invention to be attached to a wide variety of bottles or cylindrical objects. Further, none of the prior art also has a feature of providing a more secure grip to a user who would grasp the object.

III SUMMARY OF THE INVENTION

The present invention is that of a new and improved apparatus for assisting a blind or visually impaired person in locating a shampoo bottle or other bottle located within a shower. The apparatus would be a plurality of small adhesive tags attached to each other but allowing a user to separate them by incorporated perforations. Each of the tags would have a plurality of incorporated raised bubbles on its front surface. The back surface would include a peel-away backing, which would cover a sticky coating on the back surface of the small adhesive tags until the small adhesive tags would be ready for use. The present invention would preferably be placed on a shampoo bottle, allowing a user to identify the shampoo bottle by touch. Each bubble on each of the adhesive tags would be manufactured to include a micro-suction cup top-mounted on each bubble, providing the user with a more secure grip. The plurality of adhesive tags would be designed to come in a roll and would be packaged within a roll dispenser box, with the roll of adhesive tags connected to and surrounding a roller located inside the roll dispenser box. A roll dispenser box would include a slot opening to allow a plurality of small adhesive tags to be removed from the roll dispenser box and attached to a cylindrical object as needed.

It is therefore an object to the present invention to provide a new and improved apparatus to assist in the identification of specific objects for blind and visually impaired people.

It is another object to the present invention to provide a new and improved apparatus to assist in the identification of specific objects for blind and visually impaired people that is easily and efficiently manufactured.

It is yet another object of the present invention to provide a new and improved apparatus to assist in the identification of specific objects for blind and usually impaired people that is inexpensive to manufacture.

It is therefore yet another object to the present invention to provide a new and improved apparatus to assist in the identification of specific objects for blind and visually impaired people that operates by having a user use his sense of touch.

It is still another object to the present invention to provide a new and improved apparatus to assist in the identification of a specific shampoo bottle while a user would be bathing or showering, eliminating the possibility of said user using the wrong product on his or her hair.

It is still another object to the present invention to provide a new and improved apparatus to assist in the identification of specific objects for blind and usually impaired people that provides better gripping ability.

Other objects, features, and advantages of the present will become more readily apparent from the following detailed description of the preferred embodiment when considered with the attached drawings and appended claims.

IV BRIEF DESCRIPTION OF THE DRAWINGS

FIG. 5 shows a perspective view of a perforation that would separate two adjacent identification tags.

FIG. 6 shows a side view of a bubble with an incorporated top-mounted micro-suction cup.

FIG. 7 shows a perspective view of two identification tags, with the peel-away backing located on the back surface in the process of being removed.

FIG. 8 shows a cut-away side view of the roll dispenser of the present invention.

V DESCRIPTION OF THE PREFERRED EMBODIMENT

Figure 1:
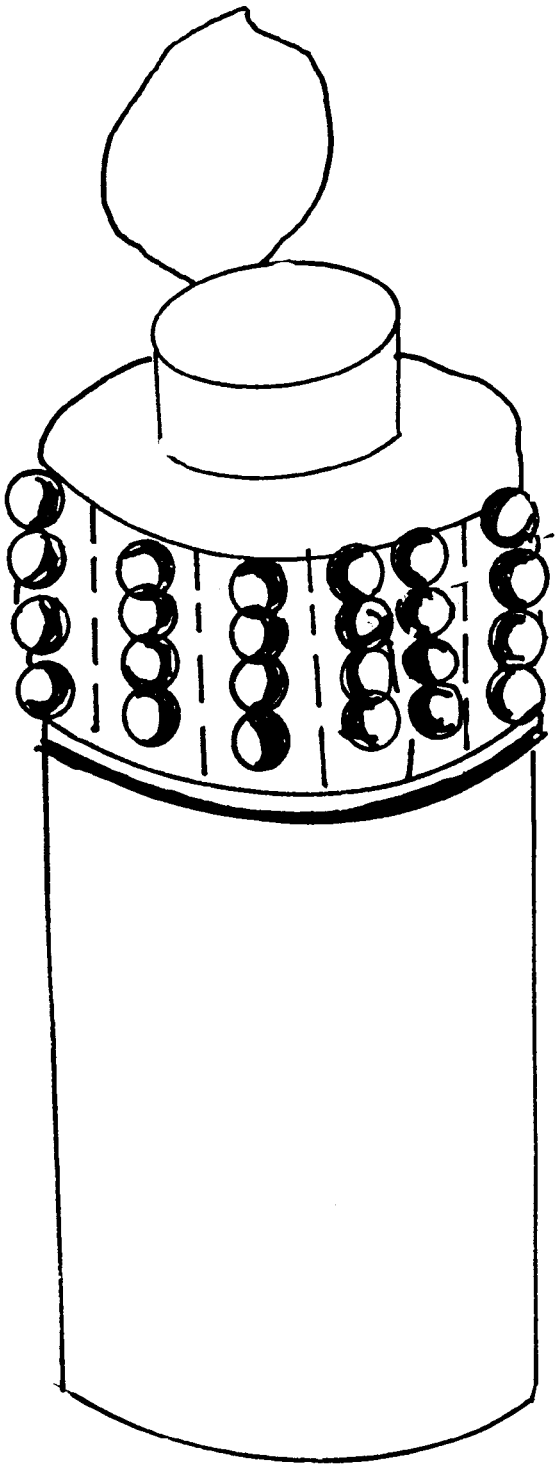
FIG. 1 is a perspective view of a plurality of identification tags.

Referring now to the present invention, FIG. 1 shows a perspective view of three identification tags 1 attached to one another. Each identification tag 1 has a front surface 4 and a back surface 2, with the back surface 2 containing an adhesive, water-resistant peel-away backing 16 removably attached to back surface 2. Back surface 2 would be a sticky surface once peel-away backing 16 would be removed and would allow one or more identification tags 1 to be fixedly mounted to a surface. Identification tag 1 would be fabricated from a flexible material.

Each identification tag 1 is rectangular in shape and preferably contains four bubbles 10 fixedly mounted to the front surface 4 of each identification tag 1, which are mounted in a linear row. Each bubble 10 would rise above front surface 4 approximately one-eighth of an inch. Each bubble 10 would have a top-mounted incorporated micro-suction cup 8 on the top surface of bubble 10, which would allow for an object with one or more identification tags 1 attached to be easily grasped by a user.

Each identification tag 1 would be connected to one or two adjacent identification tags 1 by a perforation 6. Each perforation 6 could be easily parted, thereby allowing a user to separate specific amounts of identification tags 1 into groupings of certain amounts as a user would see fit.

Figures 2, 4:
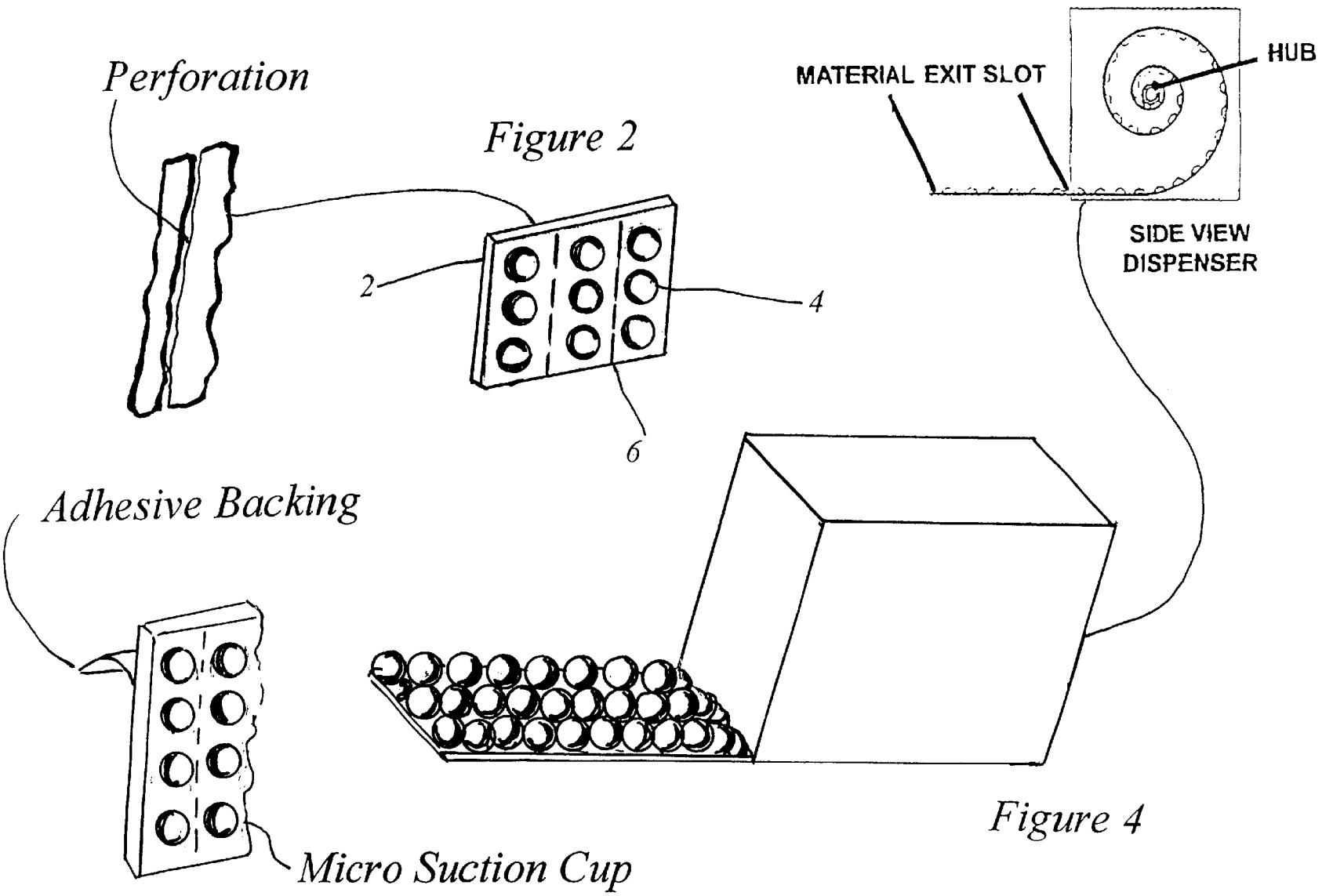
FIG. 2 is a side view of a single identification tag.
FIG. 4 shows plurality of identification tags in use, attached to a standard shampoo bottle.

FIG. 2 shows a side view of a single identification tag 1, with front surface 4 and back surface 2 clearly visible. A plurality of bubbles 10 are shown with incorporated top mounted micro-suction cups 8. Back surface 2 has attached peel-away backing 16 removably attached to it.

Figure 3:
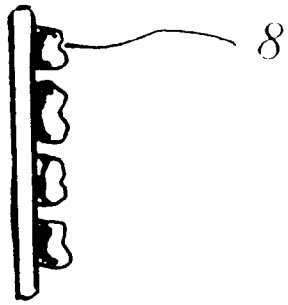
FIG. 3 shows a perspective view of a roll dispenser box.

FIG. 3 shows a perspective view of roll dispenser box 12, which is used to house a plurality of identification tags 1 prior to use. A plurality of identification tags 1 are designed to be stored within roll dispenser box 12, with and end of the plurality exiting slot opening 14, which is incorporated into a lower portion of roll dispenser box 12. Within roll dispenser box 12, the roll of identification tags 1 is designed to be formed around roller 18, which is fixedly mounted within roll dispenser box 12 and rotates freely on a central axis, allowing the proper amount of identification tags 1 to be pulled out of slot opening 14 as desired by a user.

FIG. 4 shows a plurality of identification tags 1 in use, attached to a standard shampoo bottle 3 with incorporated parts cap 5, lid 7, and dispenser hole 9. FIG. 4 shows the preferred method of use and attachment for a plurality of identification tags 1 in that the plurality of identification tags 1 have had peel-away backing 16 removed and have been attached circumferentially to the outer surface of shampoo bottle 3. When the plurality of identification tags 1 are attached as shown, shampoo bottle 3 will be much easier a blind or visually impaired person to correctly identify the bottle while bathing or showering.

FIG. 5 shows a perspective view of a perforation 6, which connects one identification tag 1 to an adjacent identification tag 1. Each perforation 6 includes a plurality of cross-links 20, which connect one identification tag 1 to an adjacent identification tag 1. Each cross-link 20 is fairly small in shape, thereby allowing a user to easily tear all the cross-links 20 in a particular perforation 6 if the user desires to do so.

FIG. 6 shows a side view of a bubble 10 with an incorporated top mounted micro-suction cup 8. As can be seen, micro-suction cup 8 extends outward, thereby providing a user with a more secure grip when looking for a shampoo bottle or other object in which a plurality of identification tags 1 have been attached.

FIG. 7 shows a perspective view of two identification tags 1, with peel-away backing 16 in the process of being removed, thereby exposing the sticky surface of back surface 1 that is appropriate for attachment.

FIG. 8 shows a cutaway side view of roll dispenser box 12. As can be seen, a plurality of identification tags 1, linked to each other by a plurality of perforations 6, are circumferentially wrapped around roller 18. The end of the plurality of identification tags 1 is permitted to exit slot opening 14, where it then can be utilized by a user as needed.

What I claim as my invention is:

1. An apparatus for assisting a blind or visually impaired person in identifying a specific object through the sense of touch, said apparatus comprising a plurality of small adhesive tags, each of said small adhesive tags including two edges and two ends, each of said small adhesive tags including a front surface and a rear surface, each of said small adhesive tags having at least one edge connected to an edge of an adjacent small adhesive tag, whereby the front surface of each small adhesive tag would include a plurality of raised bubbles fixedly mounted on said front surface, and whereby the rear surface of each small adhesive tag is sticky and includes an attached peel-away backing layer to protect the rear surface until the small adhesive tag would be ready for use.

2. An apparatus according to claim 1, wherein each of said raised bubbles includes a top-mounted outwardly-facing suction cup for an increased gripping strength.

3. An apparatus according to claim 1, in combination with a dispensing device, wherein said dispensing device comprises;

(a). A roll dispenser box, said box including an internally mounted roller that rotates on a central axis;

(b). A slot opening externally mounted on said roll dispenser box, whereby said plurality of small adhesive tags are circumferentially placed around said roller, with an end of said plurality of small adhesive tags designed to exit said slot opening externally mounted on said roll dispenser box.

* * * * *